US006942367B2

(12) United States Patent
Tausch et al.

(10) Patent No.: US 6,942,367 B2
(45) **Date of Patent: *Sep. 13, 2005**

(54) CURVED AND REFLECTIVE SURFACE FOR REDIRECTING LIGHT TO BYPASS A LIGHT SOURCE

(75) Inventors: Mark Tausch, West Chester, OH (US); Charles Alexander, Cincinnati, OH (US)

(73) Assignee: Delaware Capital Formation, Inc., Wilmington, DE (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/284,489

(22) Filed: Oct. 31, 2002

(65) Prior Publication Data

US 2004/0070976 A1 Apr. 15, 2004

Related U.S. Application Data

(60) Provisional application No. 60/418,193, filed on Oct. 15, 2002.

(51) Int. Cl.[7] ..... F21V 7/00

(52) U.S. Cl. ..... 362/346; 362/293; 362/298; 362/373

(58) Field of Search ..... 362/298, 346, 362/294, 293, 345, 373, 92, 263; 250/504 R, 492.1

(56) References Cited

U.S. PATENT DOCUMENTS

| | | | |
|---|---|---|---|
| 1,744,369 | A | 1/1930 | Dietz et al. |
| 2,108,633 | A | 2/1938 | Wiegand et al. |
| 2,393,616 | A | 1/1946 | DeReamer et al. |
| 3,060,310 | A | 10/1962 | Bertsche, Jr. et al. |
| 3,122,405 | A | 2/1964 | Pistey |
| 3,263,201 | A | 7/1966 | Pistey |

(Continued)

FOREIGN PATENT DOCUMENTS

| | | | |
|---|---|---|---|
| JP | 4-295801 | A | 10/1992 |
| JP | 11-97732 | A | 4/1999 |
| JP | 2001-296607 | A | 10/2001 |

OTHER PUBLICATIONS

Optical Coatings Japan; webpage www.technmark.nl/ocj/dichroics.htm; 3 pages.

UVTechnology Offers 100% Complete UV Cure Solutions Cool Cure Technology to the Flexo Market; webpage www.markandy.com/news091202d.htm; 2 pages.

Ronkese, B. J.; "Metal Wool and Indium Heat Sink," Aug. 1978, IBM Technical Disclosure Bulletin, vol. 21, No. 3, pp. 1143–1144.

*Primary Examiner*—Sandra O'Shea
*Assistant Examiner*—Mark Tsidulko
(74) *Attorney, Agent, or Firm*—Foley & Lardner LLP

(57) ABSTRACT

A UV curing lamp is provided which includes a curved, reflective surface which redirects incident light toward a band-pass filter while bypassing the lamp. A heat sink is provided for the band-pass filter, the heat sink containing a woolen material such as aluminum wool. A portion of the light is reflected by the curved reflective surface and is transmitted through the band-pass filter and into the heat sink, the remainder of the light being reflected by the band-pass filter. The heat sink absorbs the light transmitted through the band-pass filter and dissipates the heat associated therewith.

32 Claims, 5 Drawing Sheets

U.S. PATENT DOCUMENTS 3,329,924 A 7/1967 Henshaw, Jr.
3,344,390 A 9/1967 Dell
3,727,040 A * 4/1973 Armstrong et al. ..... 362/13
3,733,709 A 5/1973 Bassemir et al.
3,783,261 A * 1/1974 Hartmann ..... 362/18
3,819,929 A 6/1974 Newman
3,865,106 A * 2/1975 Palush ..... 128/200.18
3,900,727 A * 8/1975 Hutz ..... 362/263
3,967,385 A 7/1976 Culbertson
4,149,086 A 4/1979 Nath
4,422,100 A * 12/1983 DuVall et al. ..... 358/497
4,443,836 A 4/1984 Horiuchi et al.
4,563,589 A * 1/1986 Scheffer ..... 250/504 R
4,574,337 A 3/1986 Poppenheimer
4,604,680 A 8/1986 Levin et al.
4,644,899 A * 2/1987 Glaus ..... 118/642
5,216,820 A 6/1993 Green et al.
5,339,226 A 8/1994 Ishikawa
5,355,198 A 10/1994 Saito
5,394,319 A 2/1995 Attwood et al.
5,414,601 A 5/1995 Davenport et al.
5,440,137 A 8/1995 Sowers
5,510,964 A 4/1996 Spitler et al.
5,552,927 A 9/1996 Wheatly et al.
5,723,937 A 3/1998 Whitman et al.
5,825,041 A 10/1998 Belek et al.
5,932,886 A 8/1999 Arai et al.
6,076,943 A 6/2000 Lassovsky
6,124,600 A 9/2000 Moroishi et al.
6,200,005 B1 3/2001 Roberts et al.
6,474,837 B1 11/2002 Belliveau
6,572,370 B1 6/2003 Hampden
6,621,087 B1 * 9/2003 Bisges et al. ..... 250/492.1
6,646,278 B1 11/2003 Schwarz et al.
6,719,444 B1 4/2004 Alber et al.
6,720,566 B2 4/2004 Blandford

* cited by examiner

AIR
30
50
8
20
22
52
AIR
50
13
13
100
40
40
AIR
AIR
12
12
14
14
26
24
16

CURVED AND REFLECTIVE SURFACE FOR REDIRECTING LIGHT TO BYPASS A LIGHT SOURCE

CROSS-REFERENCE TO RELATED APPLICATIONS

This application claims priority to U.S. Provisional Patent Application Ser. No. 60/418,193, filed on Oct. 15, 2002, the contents of which are hereby incorporated by reference. In addition, this application incorporates by reference U.S. patent application Ser. Nos. 10/284,473, 10/284,487, being filed concurrently herewith.

BACKGROUND OF THE INVENTION

1. Field of the Invention

The present invention relates to lamps and the heat absorption and transfer properties associated therewith. More particularly, the invention relates in one embodiment to improving the content of light usable in ultraviolet ("UV") light curing applications along with improving the capture of unusable light and dissipating the heat associated therewith.

2. Description of the Related Art

The purpose of reflective surfaces in a UV curing system is to gather and direct the light emitted from a lamp (also referred to as a "light source") directly to a two dimensional or three dimensional plane(s) or object(s) where UV curing will take place. In general, the mechanical structure that holds these reflective surfaces and the light source is called a housing. Some reflective surfaces discussed in detail herein are, in actuality, band-pass filters. These band-pass filters transmit certain wavelengths of light and reflect other wavelengths of light. Other reflective surfaces, referred to as "reflectors" reflect substantially all light incident thereon.

The light emitted from the light source is composed of three main regions of the electromagnetic spectrum: (a) wavelengths from about 200 nm to about 400 nm are generally considered to fall within the UV portion of the spectrum; (b) wavelengths from about 400 nm to about 760 nm are generally consider to fall within the visible part of the spectrum; and (c) wavelengths from about 760 nm to about 3,000 nm are generally considered to fall within the near infrared ("IR") portion of the spectrum.

In conventional housings, the light is reflected by a planar reflector or mirror 16, as shown in FIG. 1. Inherent in this reflector design is the gathering and redirecting a part of the IR portion of the spectrum back across the surface of the lamp. This reflected IR light has been shown to cause unwanted radiant heat transfer back into the exterior and interior of the lamp. This additional heat can: (a) impair the efficient functioning of the lamp; (b) increase the operating temperature of the lamp; and (c) reduce the UV light output of the lamp.

One way to reduce the possibility of directing IR light back into the lamp is to remove the mirror 16 behind the lamp and to remove other reflective surfaces therearound that would otherwise redirect the IR light back into the lamp. However, as the mirror 16 and reflective surfaces redirect not only IR light but also UV and visible light, removing them to reduce the redirection of IR light would reduce the amount of UV light available in a UV curing application and decrease the overall efficiency of the system.

After the light is redirected in a second direction, it joins other light which originated on that second direction from the lamp; this combination of light must be separated into useable and unusable wavelengths. One way to separate the light is by using an optical filter such as a band-pass filter which may, for example, separate UV light from other types of light (e.g., IR and visible light) so that the UV light can be used in applications which depend on UV light (and which may be hampered by other types of light), such as UV curing applications.

Thus, the purpose of a band-pass filter in an optical system is to reflect light in a specific range of wavelengths and to transmit light of a different set of wavelengths. A particular type of band-pass filter, often referred to as a "cold mirror," is used to provide good reflection of light having wavelengths in a particular range and to transmit light outside of that range. For example, one type of cold mirror reflects light having wavelengths between about 200 nm and about 450 nm (i.e., UV light and the lower end of the visible light spectrum) and transmits light having wavelengths above about 450 nm, i.e., light which includes most visible light and IR light.

Band-pass filters may be used to separate light into usable and unusable light. For example, a cold mirror may be used to separate light into UV light and visible/IR light. The UV light may be reflected toward a material, such as a web, that is to be cured via a curing application. By way of contrast, the visible/IR light may be transmitted through the cold mirror (i.e., it is not directed toward the curing application at hand), to prevent unnecessary and unwanted heating of the materials that are to be cured. A prior art embodiment incorporating a band-pass filter will be described with respect to FIG. 1.

FIG. 1 is a schematic view of a prior art lamp housing 100. The lamp housing 100 contains a lamp 26 (also called a "light source 26") which projects diverging light having a variety of wavelengths from the interior 24 of the lamp 26. Some of the light is directed toward a reflective mirror 16 which reflects the light toward a band-pass filter 20, which may be a cold mirror. In some prior art embodiments, the mirror 16 is planar (as shown) whereas in other prior art embodiments the mirror 16 is curved. However, in all prior art embodiments, at least some of the light reflected by the mirror 16 is redirected back toward the light source 26.

Some of the light from the light source 26 is also reflected off shutters 12 toward the band-pass filter 20. The shutters 12, which rotate on axes 14, have inside surfaces (i.e., on the side facing the light source) which are highly polished. As a result, when an object 8 (which may be in the form of a tape or label) to be cured is moved across a window 22 in the housing 100, the shutters 12 may be opened and the polished surface of the shutters 12 used to gather and direct the light toward the band-pass filter 20.

The shutters 12 may be opened due to their being adapted to rotate on the axes 14. In a first position (not shown), the distal ends 13 of the shutters 12 approach each other, thereby substantially containing the light emitted by light source 26. In a second position, shown in FIG. 1, the distal ends 13 of the shutters 12 are separated so that the light emitted by the light source 26 can be reflected toward the band-pass filter 20.

The shutters 12 also serve a heat containment function. The temperature of the light source 26 may reach from about 650° C. to about 850° C. In some embodiments, as the light source 26 is reasonably close to the moving object 8, if the object 8 is stopped while the lamp housing 100 is emitting light, it may be preferable to protect the object 8 from the heat associated with the light emitted by light source 26 by closing the shutters 12.

The band-pass filter 20 is adapted to reflect light having a wavelength which falls within a specified range and to transmit light having wavelengths outside of that range. For example, in UV curing applications, if a cold mirror is used for the band-pass filter 20, it may reflect light having wavelengths between about 200 nm and about 450 nm (i.e., UV light coupled with the lower end of the visible light spectrum) and transmit light outside of this range including the remainder of the visible light and IR light. The light which is reflected by the cold mirror passes through a protective window 22 and may be used in applications calling for a particular type of light, e.g., UV light.

As the remaining light (e.g. visible/IR) is transmitted through the band-pass filter 20, it may be necessary to protect people and/or items which may be harmed by exposure to this light. To address this concern, the light which is transmitted through the band-pass filter 20 may pass through an air corridor 52 and into a solid heat sink 30 where it may be absorbed and converted into heat energy via radiant heat transfer.

Air, which is fed into the air corridor 52 via inlets 50, may be used to cool the heat sink 30. Similarly, air may be fed into the housing 100 via inlets 40. The air passing through the inlets 40 may be used to cool the light source 26, the mirror 16, and/or the shutters 12. Further, the heat sink 30 may be designed so that its shape and cross-sectional area will allow the heat absorbed therein to be transferred to a stream of cooling air in the air corridor 52 via forced/induced convection. Unfortunately, the heat sinks currently used tend to be large, expensive, and inefficient. Thus, although a solution, in the form of a heat sink apparatus, currently exists to absorb visible and infrared light transmitted through a band-pass filter, the solution is imperfect due to the size and cost of the heat sink apparatus.

In light of the aforementioned, it is desired to achieve one or more of the following in a new apparatus and method: (a) effectively redirecting light without unnecessarily heating of the lamp; (b) effectively absorbing visible/IR light; (c) dissipating the heat associated with the light absorption; and/or (d) reducing the size and/or cost of the current heat sinks used for this purpose.

SUMMARY OF THE INVENTION

The invention herein contains multiple embodiments including a curing lamp which includes a light source, a reflective surface, and a band-pass filter. In this embodiment, the reflective surface is positioned behind the light source and adapted to reflect light so that the light does not travel back to the light source. In addition, the band-pass filter is positioned in the path of at least some of the light which the light source is adapted to radiate and is positioned in the path of at least some of the light which the reflective surface reflects.

In another embodiment of the invention, the band-pass filter may be planar.

In another embodiment of the invention, the band-pass filter may be curved.

In another embodiment of the invention, the reflective surface may be formed of two parts.

In another embodiment of the invention, the reflective surface may be formed of two parts, wherein at least one of the two parts of the reflective surface may be a reflector.

In another embodiment of the invention, the reflective surface may be formed of two parts, wherein at least one of the two parts of the reflective surface may be a band-pass filter.

In another embodiment of the invention, the reflective surface may be a reflector.

In another embodiment of the invention, the reflective surface may be a band-pass filter.

In another embodiment of the invention, the curing lamp may also include a heat sink provided proximate the band-pass filter, i.e., the heat sink may be either adjacent the band-pass filter or separated therefrom by a small distance.

In another embodiment of the invention, the curing lamp may also include a heat sink provided proximate the band-pass filter, wherein the heat sink may be formed of a woolen material adapted to absorb light transmitted by the band-pass filter.

In another embodiment of the invention, the light source may be adapted to radiate light having a plurality of wavelengths including light having a wavelength in a first range and a wavelength outside of the first range.

In another embodiment of the invention, the light source may be adapted to radiate light having a plurality of wavelengths including light having a wavelength in a first range and a wavelength outside of the first range. In this embodiment, the band-pass filter may be adapted to reflect light having wavelengths in the first range and to transmit light having wavelengths outside of said first range.

In another embodiment of the invention, the light source may be adapted to radiate light having a plurality of wavelengths including light having a wavelength in a first range and a wavelength outside of the first range. In this embodiment, the band-pass filter may be adapted to reflect light having wavelengths in the first range and to transmit light having wavelengths outside of said first range. In addition, the curing lamp may further include a heat sink provided proximate the band-pass filter.

In another embodiment of the invention, the light source may be adapted to radiate light having a plurality of wavelengths including light having a wavelength in a first range and a wavelength outside of the first range. In this embodiment, the band-pass filter may be adapted to reflect light having wavelengths in the first range and to transmit light having wavelengths outside of said first range. In addition, the curing lamp may further include a heat sink provided proximate the band-pass filter, wherein the heat sink may be formed of a woolen material adapted to absorb the light transmitted by the band-pass filter.

In another embodiment of the invention, the light source may be adapted to radiate light having a plurality of wavelengths including light having a wavelength in a first range and a wavelength outside of the first range. In this embodiment, the band-pass filter may be adapted to reflect light having wavelengths in the first range and to transmit light having wavelengths outside of said first range. In addition, the curing lamp may further include a heat sink provided proximate the band-pass filter, wherein the heat sink may be formed of a woolen material adapted to absorb the light transmitted by the band-pass filter, and wherein the band-pass filter may be planar.

In another embodiment of the invention, the light source may be adapted to radiate light having a plurality of wavelengths including light having a wavelength in a first range and a wavelength outside of the first range. In this embodiment, the band-pass filter may be adapted to reflect light having wavelengths in the first range and to transmit light having wavelengths outside of said first range. In addition, the curing lamp may further include a heat sink provided proximate the band-pass filter, wherein the heat sink may be formed of a woolen material adapted to absorb the light transmitted by the band-pass filter, and wherein the band-pass filter may be curved.

In another embodiment of the invention, the light source may be adapted to radiate light having a plurality of wavelengths including light having a wavelength in a first range and a wavelength outside of the first range. In this embodiment, the band-pass filter may be adapted to reflect light having wavelengths in the first range and to transmit light having wavelengths outside of said first range. In addition, the curing lamp may further include a heat sink provided proximate the band-pass filter, wherein the heat sink may be formed of a woolen material adapted to absorb the light transmitted by the band-pass filter, and wherein the reflective surface may be formed of two parts.

In another embodiment of the invention, the light source may be adapted to radiate light having a plurality of wavelengths including light having a wavelength in a first range and a wavelength outside of the first range. In this embodiment, the band-pass filter may be adapted to reflect light having wavelengths in the first range and to transmit light having wavelengths outside of said first range. In addition, the curing lamp may further include a heat sink provided proximate the band-pass filter, wherein the heat sink may be formed of a woolen material adapted to absorb the light transmitted by the band-pass filter, and wherein the reflective surface may be a band-pass filter.

In another embodiment of the invention, the light source may be adapted to radiate light having a plurality of wavelengths including light having a wavelength in a first range and a wavelength outside of the first range. In this embodiment, the band-pass filter may be adapted to reflect light having wavelengths in the first range and to transmit light having wavelengths outside of said first range. In addition, the curing lamp may further include a heat sink provided proximate the band-pass filter, wherein the heat sink may be formed of a woolen material adapted to absorb the light transmitted by the band-pass filter, and wherein the reflective surface may be a reflector.

In another embodiment of the invention, the light source may be adapted to radiate light having a plurality of wavelengths including light having a wavelength in a first range and a wavelength outside of the first range. In this embodiment, the band-pass filter may be adapted to reflect light having wavelengths in the first range and to transmit light having wavelengths outside of said first range. In addition, the curing lamp may further include a heat sink provided proximate the band-pass filter, wherein the heat sink may be formed of a woolen material adapted to absorb the light transmitted by the band-pass filter, and wherein the reflective surface may be formed of two parts. In addition, at least one of the two parts of the reflective surface may be a reflector.

In another embodiment of the invention, the light source may be adapted to radiate light having a plurality of wavelengths including light having a wavelength in a first range and a wavelength outside of the first range. In this embodiment, the band-pass filter may be adapted to reflect light having wavelengths in the first range and to transmit light having wavelengths outside of said first range. In addition, the curing lamp may further include a heat sink provided proximate the band-pass filter, wherein the heat sink may be formed of a woolen material adapted to absorb the light transmitted by the band-pass filter, and wherein the reflective surface may be formed of two parts. In addition, at least one of the two parts of the reflective surface may be a band-pass filter.

In another embodiment of the invention, the reflective surface may be metallic.

In another embodiment of the invention, the reflective surface may be nonmetallic.

In another embodiment of the invention, the curing lamp may also include a heat sink provided proximate the band-pass filter, wherein the band-pass filter may be a cold mirror.

In another embodiment of the invention, the curing lamp may also include a heat sink provided proximate the band-pass filter, wherein the band-pass filter may be a cold mirror, and wherein the cold mirror may be a folding mirror.

In another embodiment of the invention, wherein the reflective surface may be coated.

In another embodiment of the invention, wherein the reflective surface may be coated and polished.

In another embodiment of the invention, the reflective surface may be formed of two parts, wherein each of the two parts of the reflective surface may be curved.

In another embodiment of the invention, the reflective surface may formed of two parts, wherein at least one of the two parts of the reflective surface is curved and spherical.

In another embodiment of the invention, the reflective surface may be formed of two parts, wherein at least one of the two parts of the reflective surface is curved and aspherical.

In another embodiment of the invention, the reflective surface may be formed of two parts, wherein at least one of the two parts of the reflective surface is curved and is formed of a series of flats.

In another embodiment of the invention, the reflective surface may be formed of two parts, wherein at least one of the two parts of the reflective surface is curved and cylindrical.

These and other features, aspects, and advantages of the present invention will become more apparent from the following description, appended claims, and accompanying exemplary embodiments shown in the drawings.

BRIEF DESCRIPTION OF THE DRAWINGS

The accompanying drawings, which are incorporated in and constitute a part of the specification, illustrate an embodiment of the invention and together with the description, serve to explain the principles of the invention.

DETAILED DESCRIPTION

Figure 1:
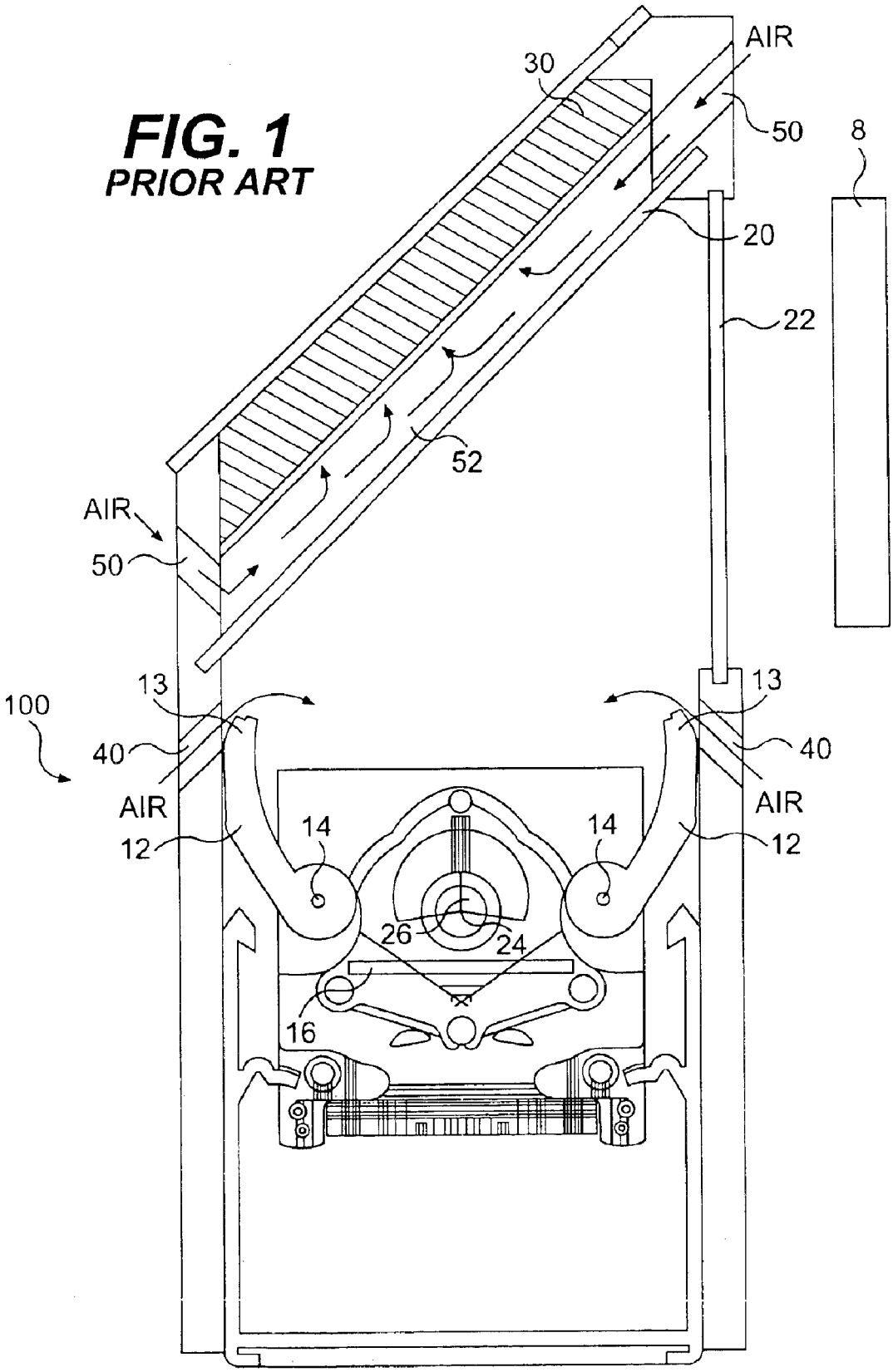
FIG. 1 PRIOR ART
FIG. 1 is a schematic view of a prior art lamp housing.

Reference will now be made in detail to embodiments of the invention, which are illustrated in the drawings. An effort has been made to use the same reference numbers throughout the drawings to refer to the same or like parts.

Figure 2:
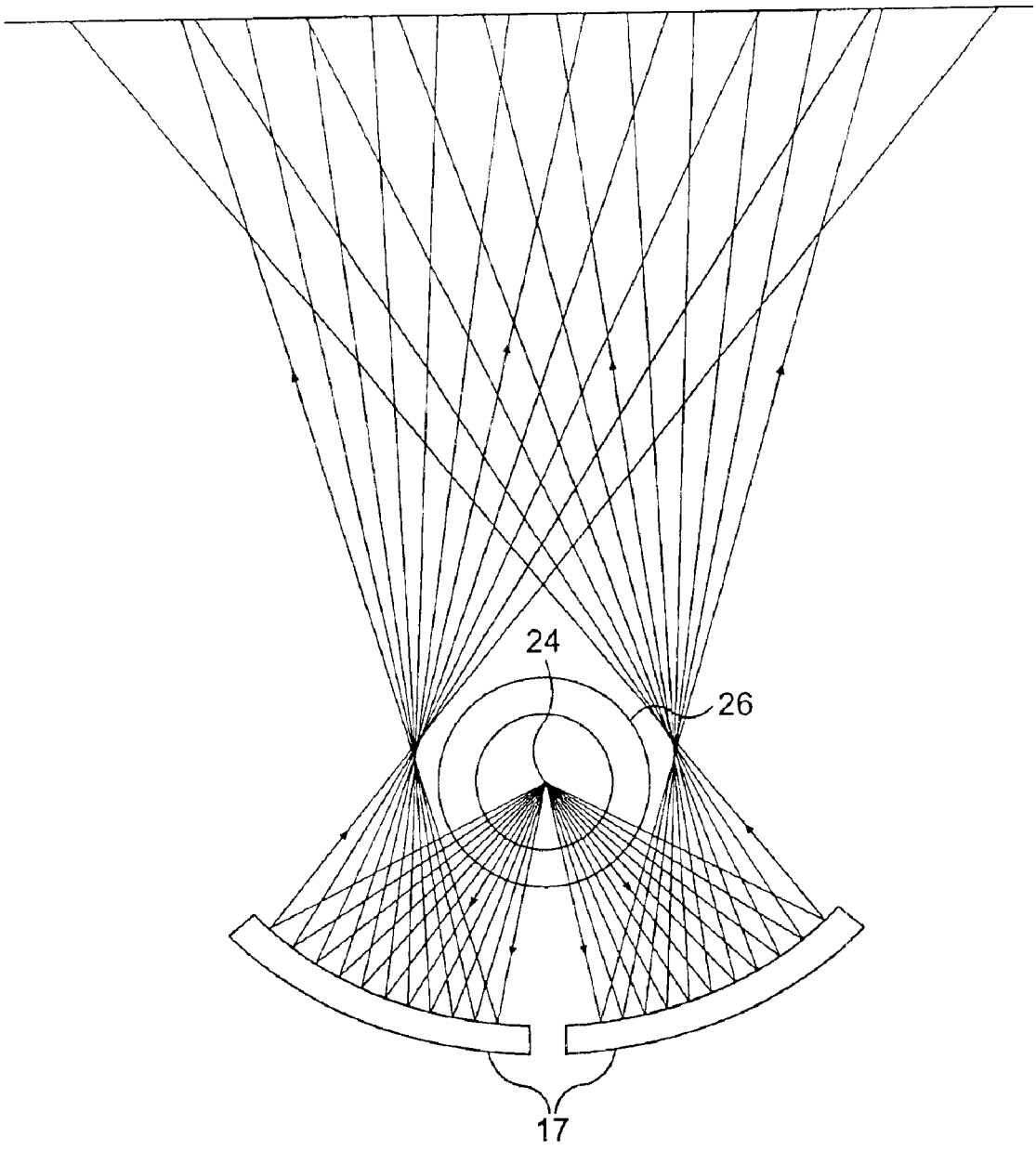
FIG. 2 is a schematic view of a two-part, curved, reflective surface, which may be a reflector or a cold mirror, which redirects incident light back toward an originating light source but in such a manner so that the redirected light is not incident on the light source.

FIG. 2 shows a curved, reflective surface 17 which is preferably in two-parts, as shown. The geometric shape of the two-part, reflective surface 17 can be made to redirect light in many different patterns including, but not limited to, a focused pattern, a collimated pattern, and a diverging pattern. As shown in FIG. 2, the reflective surface 17 is shaped to ensure that redirected light is not directed toward the light source 26.

The two-part, reflective surface 17 may be fabricated from metallic or nonmetallic materials which may be, for example, extruded, machined, formed, cast, drawn, or molded. In addition, the reflectors may be created from a substrate material which is subjected to any number of finishing methods including, but not limited to, polishing, coating, and plating. Further, the shape of each of the parts of the two-part, reflective surface 17 can be, but is not limited to, spherical, cylindrical, aspheric, and a series of flats (i.e., a series of short planar surfaces jointed together to form a curved surface).

The curved surfaces 17 may be designed using a method called "optical ray tracing" performed using computer aided design ("CAD") which traces each light ray. This method describes reflection and refraction of light when the light contacts a material such as an optical surface. Further, the ray tracing may be done automatically using optical design software programs. In addition, one or both of the parts of the two-part, reflective surface 17 may be a reflector or a band-pass filter. For example, either or both of the parts of the two-part, reflective surface 17 may be a cold mirror such as that of the type previously described.

Figure 3:
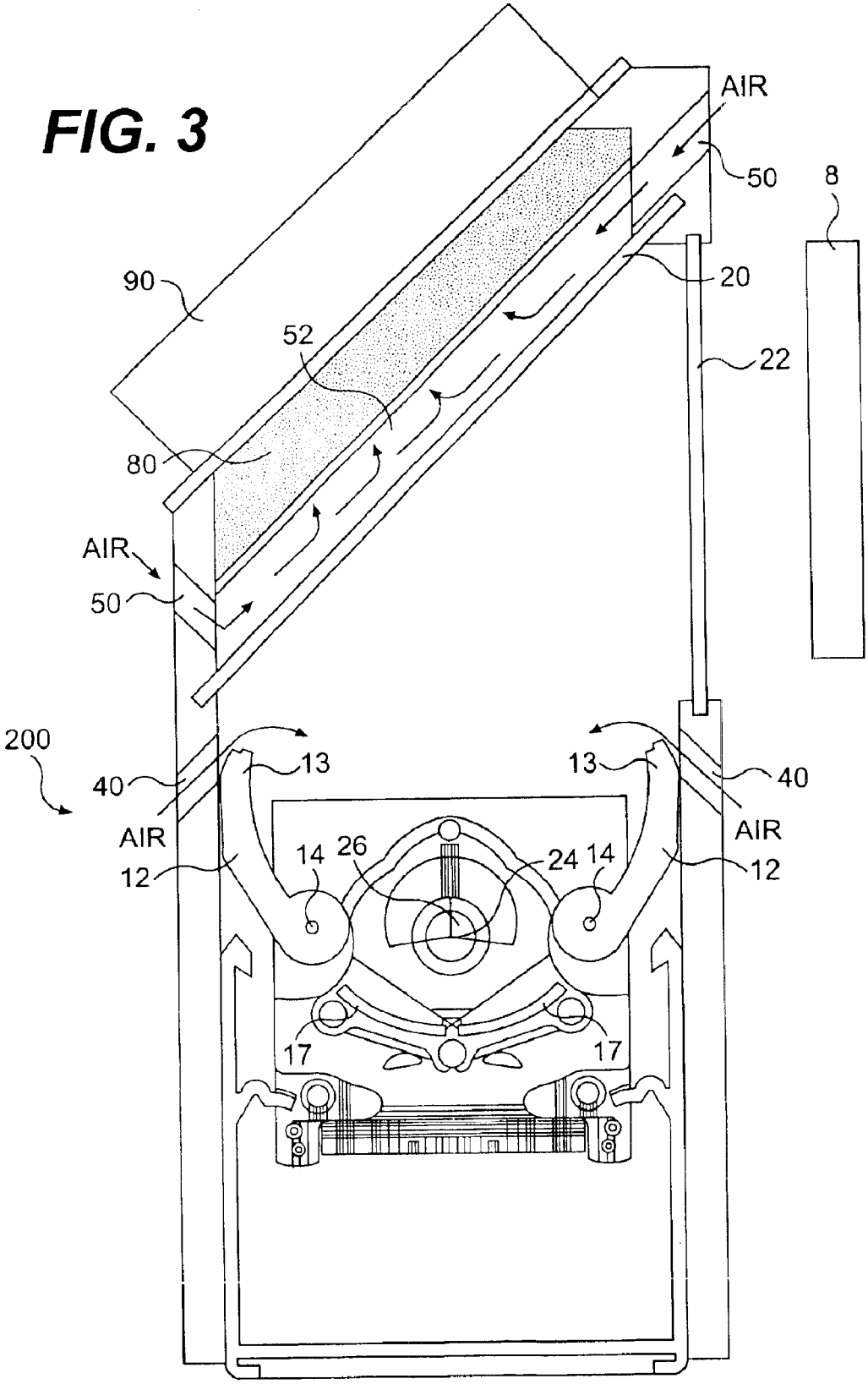
FIG. 3 is a schematic view of a lamp housing according to one embodiment of the invention incorporating the two-part, curved, reflective surface of FIG. 2.
Figure 4:
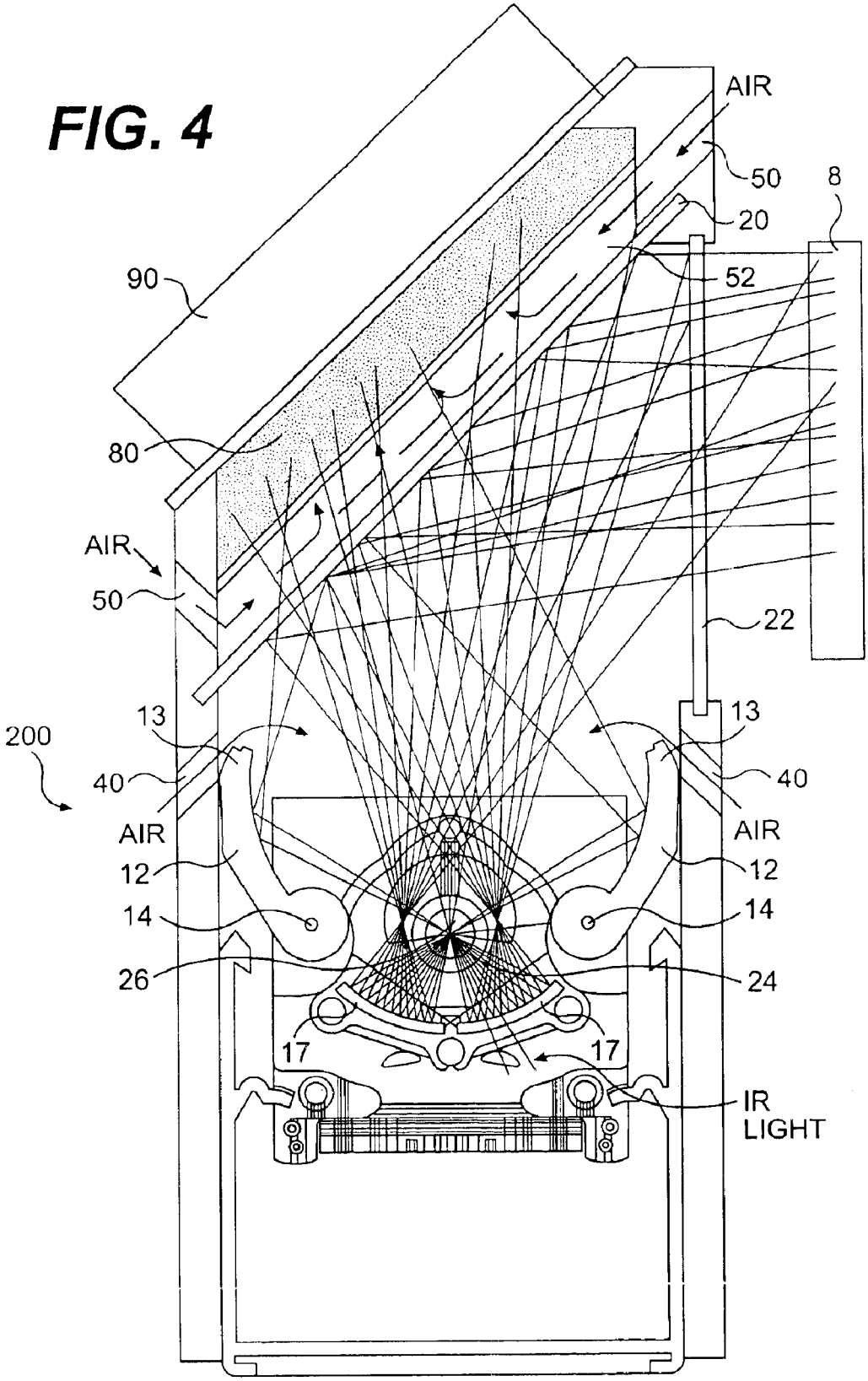
FIG. 4 is a schematic view of the lamp housing of FIG. 3 illustrating how some of the light generated by a light source is reflected by a band-pass filter so as to leave the housing via a window, whereas other light generated by the light source passes through the band pass filter.

FIG. 3 is a schematic view of a lamp housing 200 according to one embodiment of the invention. Like the prior art lamp housing shown in FIG. 1, this embodiment of the invention includes a lamp housing 200 containing a light source 26, which projects diverging light having a variety of wavelengths. In this embodiment, however, the light is directed toward shutters 12 and toward a two-part, curved, reflective surface 17, of the type shown in FIG. 2. As shown in FIG. 4, the two-part, curved, reflective surface 17 and the shutters 12 reflect the light toward a band-pass filter 20 while preventing, or at least greatly reducing, the amount of light which is redirected toward the light source 26.

Figure 5:
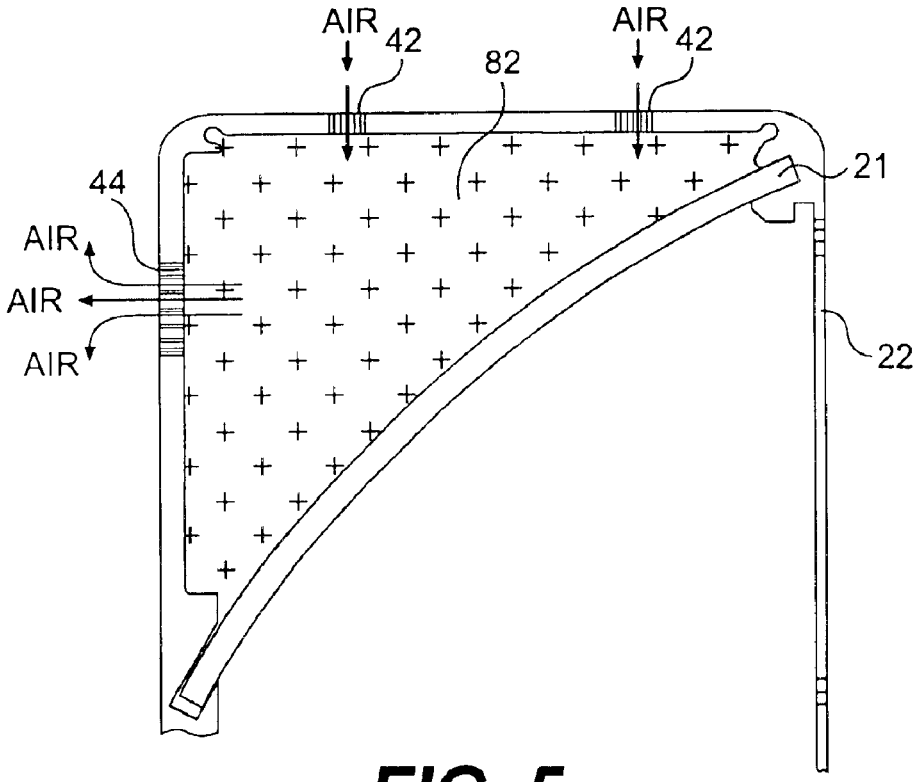
FIG. 5 is a schematic view of an alternate embodiment of a band-pass filter and an alternate embodiment heat sink which can be used in a lamp housing according to the current invention.

In one embodiment of the invention, the band-pass filter 20 may be a cold mirror. Further, it may also be a folding mirror i.e., an optical device used to change the direction of light rays. This band-pass filter 20 could be used to redirect a portion of the light (e.g., the UV light) to a two dimensional or three dimensional plane or object at which, for example, UV curing is to take place. If the band-pass filter 20 were planar in nature (as shown in FIGS. 3 and 4), the angle of this band-pass filter 20 with respect to the long axis of the lamp could be, for example, about 45°. However, there is no requirement that the band-pass filter 20 be planar in shape. Rather, the shape of the reflective surface of the band-pass filter 20 may be, but is not limited to, spherical, cylindrical, aspheric, a series of flats, for example. FIG. 5 shows an example of curved band-pass filter 21.

The band-pass filter 20, 21 may be fabricated from nonmetallic materials which are, for example, extruded, machined, formed, cast, or molded. In addition, the band-pass filter 20, 21 may be created from a substrate material which is subjected to any number of finishing methods including, but not limited to, polishing, coating, and plating. For example, the band-pass filter 20, 21 may be coated and polished.

Substrate materials transparent to particular wavelengths of light may be used in conjunction with the band-pass filter 20, 21. In one embodiment, optical coatings that reflect specific wavelength photonic energy having angles of incidence from about 0° to about 45° (and greater) may be employed. Additionally, the optical coatings may be used to transmit different specific wavelength photonic energy having angles of incidence from about 0° to about 45° (and greater).

The band-pass filter 20 is adapted to reflect light having a wavelength which falls within a specified range and to transmit light having wavelengths outside of that range. For example, if the band-pass filter 20 is a cold mirror, it may reflect light having wavelengths between about 200 nm and about 450 nm (e.g., UV light) and transmit light outside of this range, including visible light and infrared light. The light which is reflected by the band-pass filter 20 passes through a protective window 22 (as shown in FIG. 4) and may be used in applications calling for a particular type of light, e.g., UV light. For example, the light passing through the protective window 22 could be used to cure an object 8, as shown in FIG. 4.

The remaining light (e.g. visible/IR), which is transmitted through the band-pass filter 20, passes through the air corridor 52 and into the heat sink 80, where it is absorbed and converted into heat energy via radiant heat transfer. Unlike the solid heat sink 30 in the prior art, the heat sink 80 according to one embodiment of the invention is formed of a woolen material comprising a random array of fibers some of which may be curved and twisted around each other. Preferably, the heat sink 80 is formed of a metal wool such as, for example, carbon steel wool, aluminum wool, bronze wool, or stainless steel wool. Each of these metal wool types is available form International Steel Wool/BonnCo Abrasives, P.O. Box 2237, Mission, Tex. 78537. In addition, wool materials having high coefficients of thermal conductivity and low reflectivity values in a desired wavelength range may be used.

Using a woolen material for the heat sink 80 has been shown to have one or more of the following advantages over the solid prior art heat sink 30. First, the cost of the woolen heat sink 80 is much less than the cost of solid heat sinks 30. Second, the weight of the woolen heat sink 80 is far less than the prior art solid heat sink 30. Third, the woolen heat sink 80 of the present invention has been found to have greater heat dissipation capacity and efficiency than the prior art solid heat sink 30, due to the air present within it (and increased surface area associated therewith). Specifically, due to the greater surface area provided by the fibers, their thin cross-section readily gives up heat via convection heat transfer to the circulating air. Further, because of the woolen nature of the heat sink material, the air used to carry away the heat can circulate and contact nearly 100% of the fiber surface area.

Air, which is fed into the air corridor 52 via inlets 50, is used to cool the heat sink 80. In addition, the cooling of the heat sink 80 can be further aided by using a fan 90 such as, for example, a muffin fan, pressure blower, volume blower, cage blower, compressed air, natural convection fan, or other appropriate fan design. In one embodiment, the fan 90 is positioned on the side of the heat sink 80 opposite the air corridor 52. In one embodiment, the fan 90 serves to pull through the heat sink 80 air which is supplied thereto by the air corridor 52. In addition, air (which may be fed into the housing 200 via inlets 40) may be used to cool the light source 26, the shutters 12, and/or the curved reflective mirror 17.

In operation, the shutters 12 will be moved to the open position in which the distal ends 13 of the shutters are away from each other. The light source 26 will be activated to radiate light energy. Some of the light will reflect off of the two-part, curved, reflective surface 17 and off of the shutters 12 toward the band-pass filter 20, 21, whereas some of the light will travel directly from the light source 26 to the band-pass filter 20, 21. Light having wavelengths in a specified range (e.g., about 200 nm to about 450 nm) will be reflected by the band-pass filter 20, 21 and projected through the protective window 22. The remainder of the light (i.e., light having wavelengths which do not fall within the specified range) will be transmitted through the band-pass filter 20, 21 and the air corridor 50 and into the heat sink 80, where the light energy will be converted into heat energy. The heat energy will be dissipated by the influx of air in the air corridor 52 and by a fan 90, if one is provided.

FIG. 5 is a schematic view of an alternate embodiment of the band-pass filter 21 (previously mentioned), and an alternate embodiment of the heat sink 82, which can be used in a lamp housing according to the present invention. In this embodiment, the band-pass filter 21, which may be a cold mirror, is curved. However, the band-pass filter 21 performs the same function, i.e., it reflects light having wavelengths within a specified range through the protective window 22, and transmits light having other wavelengths into the heat sink 82. It should be readily appreciated that this curved band-pass filter 21 could be used in the aforementioned embodiment of the lamp housing 200, provided that the manner in which the light is reflected by the curved reflective mirror 17 and the shutters 12 were correspondingly changed to direct light toward the band-pass filter 21 in such as manner so that the band-pass filter could redirect light having specific wavelengths through the protective window 22.

FIG. 5 also depicts an alternate embodiment woolen heat sink 82. In this embodiment, an air corridor is not provided because air is channeled directly into the heat sink 82 via one or more inlets 42. Further, the air channeled into the heat sink 82 exits via one or more outlets 44. In addition, like the first embodiment, the air cooling of the heat sink 82 may be aided by a fan (not shown in FIG. 5) such as, for example, a muffin fan, volume blower, cage blower, compressed air, natural convection, or other appropriate fan type.

Figure 6:
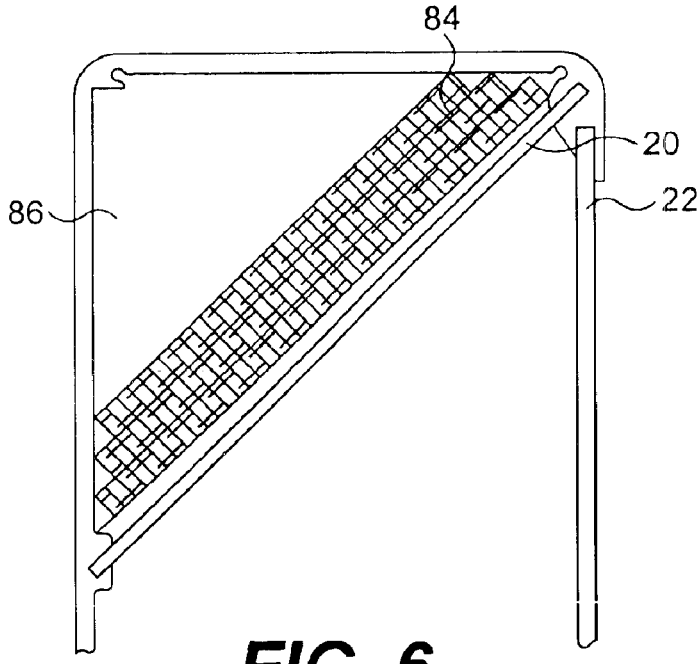
FIG. 6 is a schematic view of an alternate embodiment of a band-pass filter and associated heat sink.

FIG. 6 is a schematic view of an alternate embodiment of a band-pass filter 20, which may be a cold mirror, and associated heat sink 84. In this embodiment, a cool air corridor is not provided. However, in this embodiment, the heat sink 84, which is formed by an ordered array of woolen fibers (as shown), is provided adjacent an air pocket 86 into which heat may diffuse by convection and dissipation. An ordered array heat sink formed of a woolen material may be manufactured in such as manner as to achieve passages which have substantially fixed (and possibly the same) sizes and which are arranged in a predefined order.

Although the aforementioned describes embodiments of the invention, the invention is not so restricted. It will be apparent to those skilled in the art that various modifications and variations can be made to the disclosed preferred embodiments of the present invention without departing from the scope or spirit of the invention. For example, although each and every combination of a cold mirror 20, 21, a woolen heat sink 80, 82, 84, and/or a fan 90 was not described herein, all such combinations are fully within the scope of the invention.

In addition to the aforementioned modifications, the invention is not limited to the field of lamps. Accordingly, it should be understood that the apparatus and method described herein are illustrative only and are not limiting upon the scope of the invention, which is indicated by the following claims.

What is claimed is:

1. A curing lamp comprising:

a light source;

a reflective surface positioned behind the light source and configured to reflect light emitted by the light source so that substantially none of the emitted light is incident on the light source; and a band-pass filter positioned in the path of at least some of the light which the light source is configured to radiate and positioned in the path of at least some of the light which the reflective surface reflects.

2. The curing lamp according to claim 1, wherein the band-pass filter is planar.

3. The curing lamp according to claim 1, wherein the band-pass filter is curved.

4. The curing lamp according to claim 1, wherein the reflective surface is formed of two parts.

5. The curing lamp according to claim 4, wherein at least one of the two parts of the reflective surface is a reflector.

6. The curing lamp according to claim 4, wherein at least one of the two parts of the reflective surface is a band-pass filter.

7. The curing lamp according to claim 4, wherein each of the two parts of the reflective surface is curved.

8. The curing lamp according to claim 7, wherein at least one of the curved, reflective surfaces is spherical.

9. The curing lamp according to claim 7, wherein at least one of the curved, reflective surfaces is aspherical.

10. The curing lamp according to claim 7, wherein at least one of the curved, reflective surfaces is formed of a series of flats.

11. The curing lamp according to claim 7, wherein at least one of the curved, reflective surfaces is cylindrical.

12. The curing lamp according to claim 1, wherein the reflective surface is a reflector.

13. The curing lamp according to claim 1, wherein the reflective surface is a band-pass filter.

14. The curing lamp according to claim 1, further comprising:

a heat sink provided proximate the band-pass filter.

15. The curing lamp according to claim 14, wherein the heat sink is formed of a woolen material adapted to absorb light transmitted by the band-pass filter.

16. The curing lamp according to claim 14, wherein the band-pass filter is a cold mirror.

17. The curing lamp according to claim 16, wherein the cold mirror is a folding mirror.

18. The curing lamp according to claim 1, wherein the light source is adapted to radiate light having a plurality of wavelengths including light having a wavelength in a first range and a wavelength outside of the first range.

19. The curing lamp according to claim 18, wherein the band-pass filter is adapted to reflect light having wavelengths in the first range and to transmit light having wavelengths outside of said first range.

20. The curing lamp according to claim 19, further comprising:

a heat sink provided proximate the band-pass filter.

21. The curing lamp according to claim 20, wherein the heat sink is formed of a woolen material adapted to absorb the light transmitted by the band-pass filter.

22. The curing lamp according to claim 21, wherein the band-pass filter is planar.

23. The curing lamp according to claim 21, wherein the band-pass filter is curved.

24. The curing lamp according to claim 21, wherein the reflective surface is formed of two parts.

25. The curing lamp according to claim 24, wherein at least one of the two parts of the reflective surface is a reflector.

26. The curing lamp according to claim 24, wherein at least one of the two parts of the reflective surface is a band-pass filter.

27. The curing lamp according to claim 21, wherein the reflective surface is a band-pass filter.

28. The curing lamp according to claim 21, wherein the reflective surface is a reflector.

29. The curing lamp according to claim 1, wherein the reflective surface is metallic.

30. The curing lamp according to claim 1, wherein the reflective surface is nonmetallic.

31. The curing lamp according to claim 1, wherein the reflective surface is coated.

32. The curing lamp according to claim 31, wherein the reflective surface is polished.

* * * * *